United States Patent [19]

Gullickson

[11] Patent Number: 4,675,954

[45] Date of Patent: Jun. 30, 1987

[54] COVER FOR CONTROL MECHANISM

[76] Inventor: Daniel J. Gullickson, 633½ Appleton St., Menasha, Wis. 54952

[21] Appl. No.: 822,473

[22] Filed: Jan. 27, 1986

[51] Int. Cl.[4] ..... A44B 11/25

[52] U.S. Cl. ..... 24/633; 24/573

[58] Field of Search ..... 24/573, 574, 633, 634, 24/636, 637, 644, 664, 656, 173; 297/482; 354/64

[56] References Cited

U.S. PATENT DOCUMENTS

| | | | |
|---|---|---|---|
| 247,709 | 9/1981 | Sweyea et al. | 24/574 |
| 1,820,323 | 8/1931 | Powell | 24/633 |
| 2,738,561 | 3/1956 | Trilling et al. | 24/636 |
| 2,816,340 | 12/1957 | Domenech et al. | 24/634 |
| 3,484,908 | 12/1969 | Lamb | 24/574 |
| 3,502,013 | 3/1970 | Shimoda | 354/64 |
| 3,566,455 | 3/1971 | Kuszynski | 24/633 |
| 3,703,749 | 11/1972 | Pfabe | 24/574 |
| 3,886,632 | 6/1975 | Bako | 24/173 |
| 4,157,841 | 6/1979 | Bergman et al. . | |
| 4,392,280 | 7/1983 | Gavagan | 24/637 |
| 4,408,373 | 10/1983 | Miskowicz . | |
| 4,425,688 | 1/1984 | Anthony et al. . | |
| 4,457,052 | 7/1984 | Hauber . | |
| 4,497,094 | 2/1985 | Morris | 24/633 |
| 4,502,194 | 3/1985 | Morris et al. | 24/633 |

FOREIGN PATENT DOCUMENTS

| | | | |
|---|---|---|---|
| 3331435 | 3/1985 | Fed. Rep. of Germany | 24/633 |

*Primary Examiner*—Victor N. Sakran

*Attorney, Agent, or Firm*—Thomas D. Wilhelm

[57] ABSTRACT

A cover for a control mechanism. Activation of the control with the cover in place requires more strength than a child has; thus a child cannot, as a rule, activate the control. Concurrently, activation of the control with the cover in place does not require more strength than an adult has, so an adult can activate the control. The cover may be used over a release control on a seat belt buckle. The portion of the cover overlying the control is generally deflectable, so that an adult may activate the control through the cover. Regarding deflectability of the cover, it is rigid and stiff enough that a child may not deflect it enough to activate the control, while being simultaneously sufficiently flexible and resilient that the control may be activated by an adult by deflection of the cover.

28 Claims, 11 Drawing Figures

COVER FOR CONTROL MECHANISM

BACKGROUND OF THE INVENTION

This invention pertains to seat belts as used in passenger vehicles, particularly as used to retain children.

Seat belts have been shown to have great utility in preventing injury to vehicle passengers. And belts have been designed, and are available, which are easily buckled and easily unbuckled, and which are effective to retain passengers, whether child or adult. Specific belts have also been designed, and are available, for use with children and for use with specially designed seats for children to sit in; and which combination of seats and restraining belts are effective to cushion the child and to restrain the child from leaving the seat, falling out of it, or being thrown from it.

But such cushioning and restraint are effective only so long as the restraining seat belt, or belts, remain buckled. If the seat belt is unbuckled, whether intentionally, or unintentionally, the protective capability of the belt, and any associated cushioning of the seat, is no longer of any great effect.

Since children, and particularly young children, do not like to be restrained, thre is considerable difficulty, from time to time, with children who learn to unbuckle their own, or a sibling's, seat belt. Since seat belts are designed in such a way that they are easy to unbuckle, a child, by the age of two years, for example, may have already learned how to unbuckle a seat belt. Once the belt is unbuckled, it is, of course, no longer of any benefit to the intended user. Even worse, if a child in an elevated seat, such as most special child's seats are, becomes unbuckled, the child may fall out of the seat and be injured, or scared by the fall.

A further problem is that an adult accompanying a child may be concerned about a child who unbuckles a seat belt, and may thus be distracted from driving, as in a car. Such distraction may result in an accident, which would usually happen while the child is unprotected. So not only does the child become unprotected, but the child's actions may indirectly lead to an accident happening while the child is thus unprotected.

There would thus be substantial benefit in a cover which fits over the release control on a seat belt buckle if the cover would prevent a child from unbuckling the buckle but would allow an adult to unbuckle it.

It is an object of the invention to provide covers for control mechanisms, which covers prevent activation of the control by a child but allow activation of the control by an adult.

It is another object to provide covers for seat belt buckle release controls.

It is a more specific object to provide seat belt buckle covers which prevent the buckle being unbuckled by a child but allow the buckle to be unbuckled by an adult.

SUMMARY OF THE INVENTION

In one sense the invention is seen to be an improved cover for a control mechanism where the cover prevents activation of the control by a child, but allows activation of the control by an adult. This is effected by the cover having sufficient rigidity and inflexibility that the strength of a child is insufficient to deflect the cover and the control enough to activate the control, and having sufficient flexibility and resilience that the greater strength of an adult is sufficient to deflect the cover and the control enough to activate the control.

The cover itself has a surface which covers the control, and there is provided means for holding the cover in covering relationship over the control. Preferably, with the cover in use, the control is selectively activatable by adults only, through the cover, by deflection of the cover to the control, and further deflection thereafter to activate the control. By properly designing the relative rigidity and flexibility of the cover, a child will not have sufficient strength to deflect the cover to the control and also have sufficient strength to further deflect the cover and the control to activate the control.

The preferred anticipated application of the invention is on controls for releasing of joined objects, such as releasing, or unbuckling of buckled seat belt buckle elements. In preferred embodiments, the joined object, or elements, hold the cover in covering relationship over the control while the objects or elements are in joined relationship.

The cover is most effective when it is spaced from the control mechanism. The surface portion of the cover which is in covering relationship over the control may be elevated away from the balance of the adjoining cover surface, such as to provide spacing between the cover and the control.

In another sense, the invention is a cover for the release control on a seat belt buckle. It is preferred that the cover be effective to prevent a child from activating the release control. Preferably the cover is so designed and configured in relationship to the seat belt buckle that the release control may be activated by an adult by pressing the cover against the buckle. Thus the cover is effectively resiliently deflectable by an adult, but resists substantial deflection by a child.

The invention may also be considered to be an assembly, including the two buckle elements which may be buckled together, and the cover which covers the release control on one of the buckle elements.

In preferred embodiments of the cover, the cover has a passage, or slot, in it that one of the buckle elements, or other joined objects, passes through as the buckle elements are buckled. Thus the cover cannot be detached, or otherwise removed from the assembly while the buckle is buckled.

The cover may alternately be otherwise attached to the buckle element; as by an extension from the covering surface attaching the cover to the buckle element or by something on the cover holding the cover to the buckle element.

In a preferred design, the cover is in the form of a sleeve which has one open end, for ease of installing it on a buckle element, and a substantially closed end. The closed end has a passage, or slot, in it which allows the male element to pass through the passage as the buckle elements are being buckled. The closed end is thus trapped between the buckle elements when the buckle is buckled, and cannot be taken off until the buckle is unbuckled.

The desired degree of relative flexibility, inflexibility and rigidity may apply to the entire cover, or may apply only to that portion of the cover which is over the control, as a design choice.

In some cases, it is preferred the cover be opaque.

DETAILED DESCRIPTION OF THE ILLUSTRATED EMBODIMENTS

Figure 1:
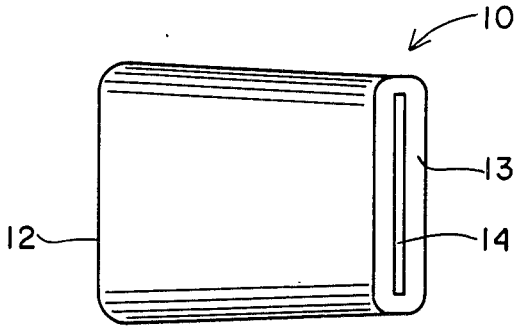
FIG. 1 is a pictorial view of a buckle cover of this invention.
Figure 2:
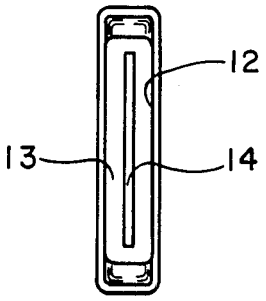
FIG. 2 is a pictorial view of the cover of FIG. 1, taken from the left side of FIG. 1 looking toward the right, and showing the inside of the cover.

A preferred version of the covers of the invention is seen in FIGS. 1 and 2. A cover 10 is seen to be of a generally sleeve-type nature with an open end 12 on the left of FIG. 1, and being the viewing direction of FIG. 2. The other end 13 of the sleeve is generally closed, with a passage 14 for receiving the male buckle element. In preferred embodiments, the cover is tapered from the open end toward the closed end, as best illustrated in FIG. 2.

Figure 3:
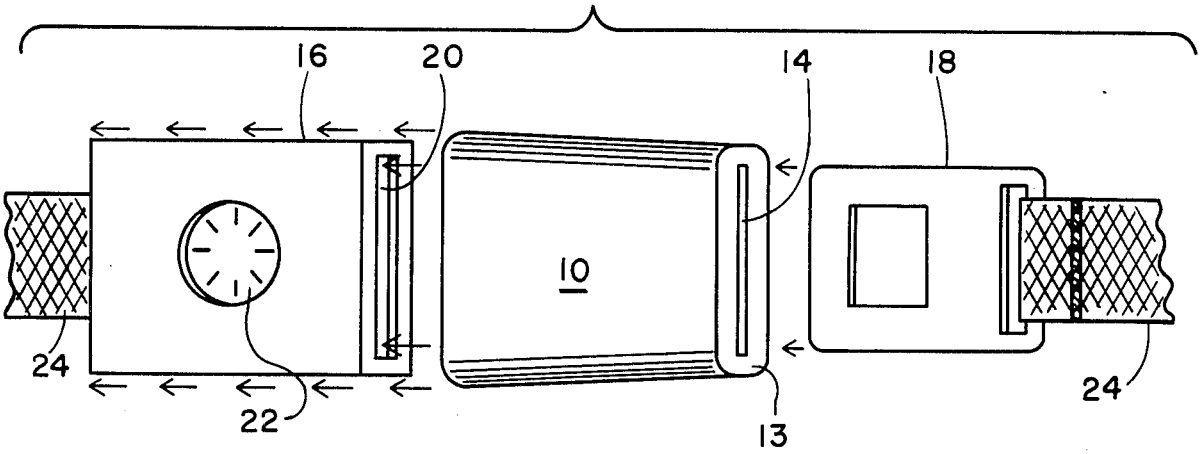
FIG. 3 is an exploded drawing showing the cover and the male and female buckle elements relative to the way in which they are assembled together.
Figure 4:
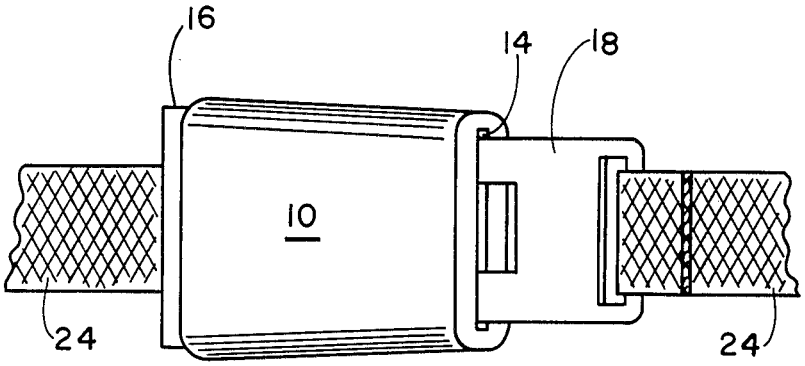
FIG. 4 shows the cover over the female buckle element and the male buckle element partially inserted.
Figure 5:
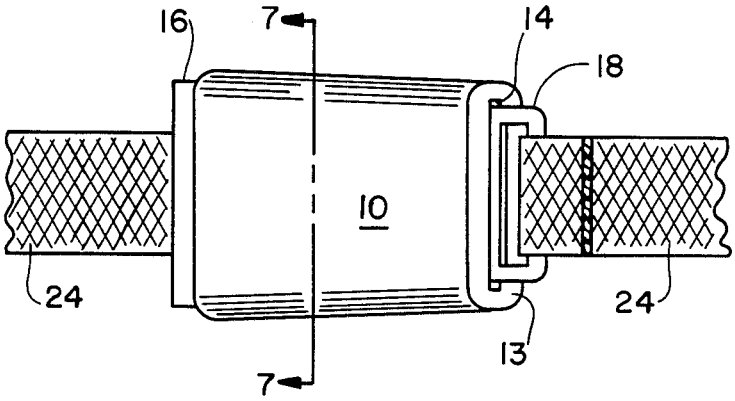
FIG. 5 shows the buckle elements buckled, with the cover in place.

FIGS. 3, 4, and 5 show the progressive relationships of the female buckle element 16, the male buckle element 18 and the cover 10 as the elements are joined to make the buckled and covered assembly. In FIG. 3, the three assembly components are lined up as for assembly. Arrows extend from the edges of male element 18 through slot 14 in cover 10 and into slot 20 of female buckle element 16. Similarly, arrows extend from the edge of cover 10 along the outer edges of female buckle element 16 to show that cover 10 covers the major portion of element 16 in the buckled assembly. Female buckle element 16 has a release control 22.

In FIG. 4, cover 10 has been positioned over female buckle element 16 as in finished assembly, and male element 18 is partially inserted through passage 14 and into female buckle element 16. Both buckle elements 16 and 18 may be further attached, as to a vehicle structure, by conventional belt webbing 24.

Figure 6:
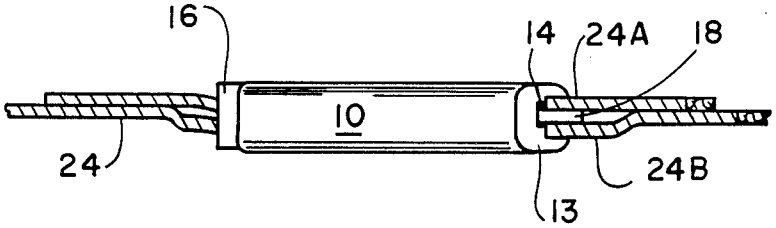
FIG. 6 is a side view of FIG. 5, showing particularly the relative width of the passage as compared to the thickness of the webbing around the male buckle element.

FIG. 5 shows the completed assembly, with the buckle buckled. As best seen in FIG. 6, the closed end 13 of cover 10 is trapped, in the completed assembly, between female buckle element 16 and the webbing 24 attached around male buckle element 18. It is particularly important in this embodiment that passage 14 be small in relation to the combined thicknesses of the male buckle element 18 and the two thicknesses of webbing 24A and 24B. With these combined thicknesses being larger than the width of passage 14, the combination serves to prevent cover 10 from being slid off buckle element 16 and back over element 18. Likewise, the small size of passage 14, in combination with end 13, also serves as a stop to prevent cover 10 from being slid past buckle element 16.

Figure 7:
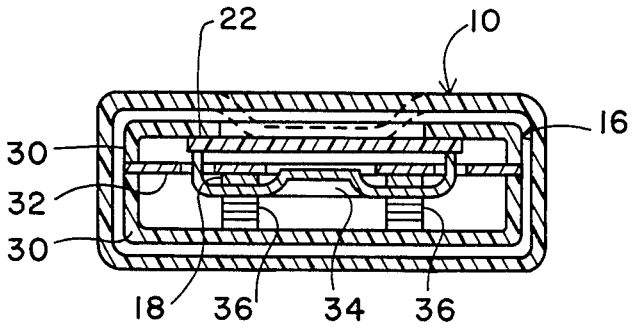
FIG. 7 shows a cross-section of the buckled assembly, taken at 7—7 of FIG. 5.

FIG. 7 shows the buckled assembly of FIG. 5 in crosssection with particular focus on cover 10. A portion of cover 10 is shown in dashed outline as being deflected to the surface of release control 22 from its preferred resting position spaced from control 22. The spacing of cover 10 from control 22 is desired in order to prevent the release of the buckle due to a small deflection of cover 10.

As seen in FIG. 7, buckle element 16 is of generally conventional construction as seen in U.S. Pat. No. 4,425,688, herein incorporated by reference. It has a casing 30 with upper and lower elements thereof, generally enclosing the buckle element 16. Plate 32 serves as an internal spacer. Latch 34, working cooperatively with control 22 and springs 36, holds the male element 18 securely locked in female element 16.

Figure 8:
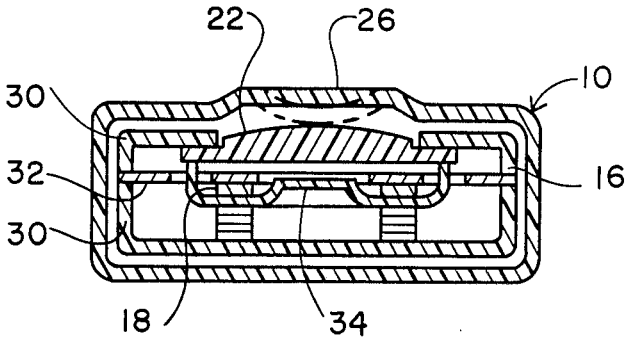
FIG. 8 shows a cross-section of another embodiment of the buckle and cover assembly.

In FIG. 7, the release control 22 is recessed from the surface of buckle element 16, and so the cover may extend straight across element 16 while being spaced from release control 22. In the embodiment illustrated in FIG. 8, release control 22 extends generally to the surface of buckle element 16; and so a portion 26 of cover 10 is elevated above the main surface of the cover 10 which is on that side of buckle element 16. A continuation of the main surface under portion 26 would be on the same side of portion 26 as in control 22, as is obvious from FIG. 8. The purpose of the elevation is primarily to maintain a space between the cover 10 and release control 22. Portion 26 is shown in dashed outline as being deflected to control 22.

Figure 9:
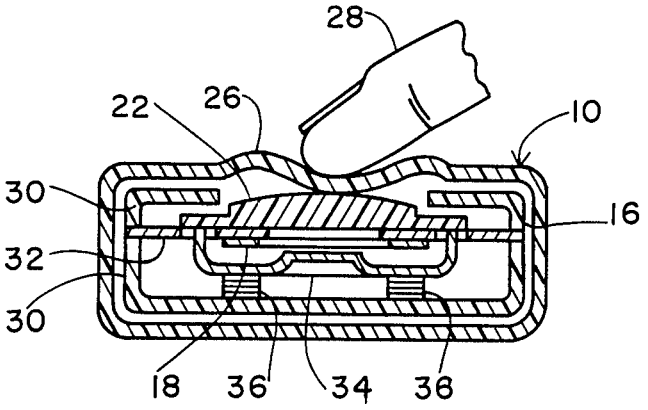
FIG. 9 shows a cross-section as in FIG. 7 and with a person's finger shown activating the buckle release mechanism.

FIG. 9 shows a person's finger 28 deflecting portion 26 and pushing the control 22 downwardly, such that latch 34 is pushed, against springs 36, out of engagement with male buckle element 18, thus releasing it for the unbuckling of buckle elements 16 and 18.

Figure 10:
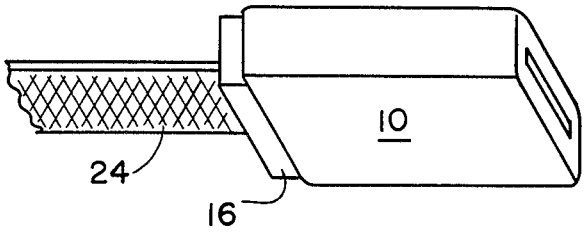
FIGS. 10 and 11 show bottom views of subassemblies of female buckle elements and covers.
Figure 11:
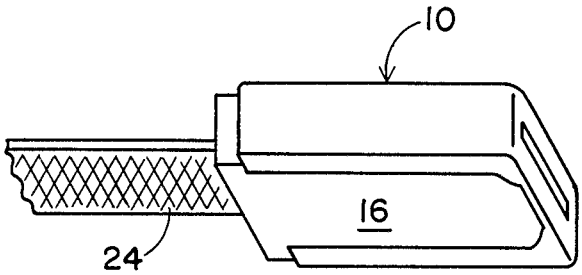

FIGS. 10 and 11 show bottom views of covers 10 of the invention assembled to female buckle elements 16. FIG. 10 shows a cover which is generally an overall sleeve. FIG. 11 shows a cover which extends onto the bottom of element 16, but does not generally extend all the way across it.

Cover 10 may be held in covering relationship over control 22 by any means, so long as the cover cannot be detached, or disassembled, from buckle element 16 while the buckle elements are buckled. Thus, retaining elements may extend from the covering surface of cover 10 to element 16 and be retained thereto. Similarly, element 16 may be modified to receive a cover 10 and hold it in place over control 22. Further, cover 10 may provide its own retaining means as in FIGS. 3–6, 10 and 11.

In relation to the primary use anticipated herein, cover 10, and particularly the portion which is adjacent control 22, is constructed of such a material and in such a thickness that it successfully resists being deflected by a child in an amount which would allow for the release of male element 18 from the buckled assembly. Yet it has enough flexibility and resilience that it can be so deflected by an adult, to so release element 18 from the assembly.

Appropriate materials for cover 10 are such as the various plastics, which may be used in single or multiple layer structures. Exemplary of useful materials are certain of the polyethylenes, particularly the higher density polyethylenes; polypropylene, and polyvinyl chloride. Those skilled in the art will readily recognize other appropriate materials. The particular thickness will depend on the material selected, but will, on the whole, be of the order of 25 mils to 125 mils.

Since the cover is intended to be used in protection of young children who do not comprehend the danger of not being buckled in a seat belt, it will generally be designed to resist unbuckling of a child of up to the age of 8 years, more or less, the expectation being that children older than that will generally not be well served by such restraints. Further, covers which resist unbuckling by the preponderance of older children would also be difficult for some adults to unbuckle, and thus may be inappropriately resistant to unbuckling in general. Thus, wherever a child is referred to herein, as regards the oldest child not having the strength to unbuckle a covered seat belt, I mean an hypothetical child of up to about 7 years of age and having average strength. Thus a cover which permits unbuckling of the seat belt by the force which can be applied by an average 7 year old child is not part of this invention. A cover which prevents opening by the force which be applied by children in any one hypothetical age group of 7 years or less, especially 4 years or less, and most especially 2 years or less, is part of this invention. The children for which the instant seat belt buckle covers are believed to be especially appropriate are those in the age range of about 18 months to about 7 years, most especially about 2 years to about 4 years. So the rigidity of covers may be geared to prevention of opening the buckles by children in these age ranges. By an adult, I mean a physically mature person of at least about 16 years of age or more; recognizing that people mature physically at different rates, and so considerable variation may exist among individuals, which is consistent with the average ages recited herein.

Thus, the design of the covers of this invention makes it desirable to carefully control the relative rigidity, flexibility and resilience of the cover so that it adequately resists the determined efforts of a child, but is readily responsive to being deformably deflected by an adult as seen in FIG. 9; recognizing that virtually every child will, at some age, attain enough strength to unbuckle the buckle himself.

The relative flexibility, rigidity and resilience of the cover may apply, as desired, to only that portion of the cover which is near the release control 22. The remainder of the cover and its elements may be of more, or less, flexible and resilient material, so long as the integrity of the cover and its protection capabilities, are preserved.

Particularly for use with regard to young children, whose attention may be easily distracted, it is preferred that the cover 10 be opaque. Where the release control is thus not visible, it may more readily be forgotten by the child.

In using the covers of the invention, cover 10 is placed over the female buckle element 16 as in FIG. 4. Male buckle element 18 is passed through passage 14 and into slot 20 in female element 16. Male element 18 is pushed into female element 16 until it is secured in place by latch 34 or the like. To unbuckle the buckle elements, cover 10 is deflected over control 22 and cover 10 and control 22 are further pushed, releasing buckle element 18 from latch 34, all as seen in FIG. 9.

After the buckle is unbuckled, it is usually preferred to leave cover 10 on buckle element 16, ready for the next use.

Thus it is seen that the invention provides covers for control mechanisms, which covers prevent activation of the control by a child but allow activation of the control by an adult.

More particularly in line with the illustrated embodiments, the invention provides covers for seat belt buckle release controls.

Finally, the invention provides seat belt buckle covers which prevent the buckle being unbuckled by a child, but allow the buckle to be unbuckled by an adult.

Having thus described the invention, what is claimed is:

1. A buckled seat belt buckle assembly, said assembly comprising:

(a) a first buckle element having a release control;

(b) a second buckle element buckled to said first element; and (c) a cover joined into said assembly, said cover comprising a first surface overlying, and spaced from, said release control, said first surface being deflectable by resilient deformation thereof to thereby activate said release control;

the cooperative configurations of said first and second buckle elements and said cover being such that the buckling of said assembly is effective to hold said cover in covering relationship over said release control, and wherein said cover is released from said assembly when said first and second buckle elements are unfastened from each other.

2. A buckle assembly as in claim 1 and including an enlarged portion cooperating with said second buckle element and thereby preventing said cover from being removed from said assembly over said second buckle element.

3. A buckle assembly as in claim 1 wherein a portion of said cover is trapped between said first buckle element and an enlarged portion cooperating with said second buckle element, said entrapment being effective to hold said cover in covering relationship over said control.

4. A buckle assembly as in claim 1, said first surface depending from a second surface, and wherein a continuation of said second surface would be on the same side of said first surface as is said control.

5. A buckle assembly as in claim 4, said first surface depending from a second surface, and wherein a continuation of said second surface would be on the same side of said first surface as is said control.

6. A buckle assembly as in claim 1 and including means extending from said first surface for attaching said cover to said first buckle element.

7. A buckle assembly as in claim 1, the portion of said cover overlying said control being opaque.

8. A buckle assembly as in claim 5, the portion of said cover overlying said control being opaque.

9. A buckle assembly as in claim 1, the deflectability of said first surface being such that said release control can selectively be activated by resilient deformative deflection of said cover, by an adult, but not by the force which can be applied by a child of age 2 years.

10. A buckle assembly as in claim 1 wherein said cover comprises a sleeve having an open end and a generally closed end, said generally closed end having a passage therethrough compatible with receiving one of said first and second buckle elements.

11. A buckle assembly as in claim 9 wherein said cover comprises a sleeve having an open end and a generally closed end, said generally closed end having a passage therethrough compatible with receiving one of said first and second buckle elements.

12. A seat belt buckle fastener assembly, comprising:

(a) first male and second female fastening elements, said first element being receivable into said second element for fastening said first and second fastening elements together in assembling said assembly, said second element having a release control; and (b) a cover joined to said assembly, said cover comprising a first surface overlying and spaced from, said release control, said first surface being deflectable by resilient deformation thereof to thereby activate said release control, the cooperative configurations of said first and second fastening elements and said cover being such that the fastening together of said assembly is effective to hold said cover in covering relationship over said release control, and including an enlarged portion cooperating with said first male element and whereby preventing said cover from being removed from said assembly over said first male element.

13. A fastener assembly as in claim 12 wherein a portion of said cover is trapped between said second female element and an enlarged portion cooperating with said male member, said entrapment being effective to hold said cover in covering relationship over said control.

14. A fastener assembly as in claim 12 wherein said first and second fastener elements comprise buckle elements.

15. A fastener assembly as in claim 13 wherein said first and second fastener elements comprise buckle elements.

16. A fastener assembly as in claim 12, said first surface depending from a second surface, and wherein a continuation of said second surface would be on the same side of said first surface as in said control.

17. A fastener assembly as in claim 13, said first surface depending from a second surface, and wherein a continuation of said second surface would be on the same side of said first surface as in said control.

18. A fastener assembly as in claim 12 and including means extending from said first surface for attaching said cover to said first buckle element.

19. A fastener assembly as in claim 12, the portion of said cover overlying said control being opaque.

20. A fastener assembly as in claim 13, the portion of said cover overlying said control being opaque.

21. A fastener assembly as in claim 14, the portion of said cover overlying said control being opaque.

22. A fastener assembly as in claim 15, the portion of said cover overlying said control being opaque.

23. A fastener assembly as in claim 12, the deflectability of said first surface being such that said release control can selectively be activated by resilient deformative deflection of said cover, by an adult, but not by the force which can be applied by a child of age 2 years.

24. A fastener assembly as in claim 14, the deflectability of said first surface being such that said release control can selectively be activated by resilient deformative deflection of said cover, by an adult, but not by the force which can be applied by a child of age 2 years.

25. A fastener assembly as in claim 12 wherein said cover comprises a sleeve having an open end and a generally closed end, said generally closed end having a passage therethrough compatible with receiving one of said first and second fastening elements.

26. A fastener assembly as in claim 14 wherein said cover comprises a sleeve having an open end and a generally closed end, said generally closed end having a passage therethrough compatible with receiving one of said buckle elements.

27. A fastener assembly as in claim 23 wherein said cover comprises a sleeve having an open end and a generally closed end, said generally closed end having a passage therethrough compatible with receiving one of said first and second fastening elements.

28. A fastener assembly as in claim 24 wherein said cover comprises a sleeve having an open end and a generally closed end, said generally closed end having a passage therethrough compatible with receiving one of said buckle elements.

* * * * *